US007552757B2

(12) United States Patent
Hassdenteufel et al.

(10) Patent No.: US 7,552,757 B2
(45) Date of Patent: Jun. 30, 2009

(54) HEAT EXCHANGER MODULE FOR A MOTOR VEHICLE

(75) Inventors: Klaus Hassdenteufel, Gerlingen (DE); Volker Kurz, Stuttgart (DE); Chi-Duc Nguyen, Stuttgart (DE); Dieter Schweidler, Oberriexingen (DE); Michael Spieth, Gomaringen (DE)

(73) Assignee: BEHR GmbH & Co. KG, Stuttgart (DE)

( * ) Notice: Subject to any disclaimer, the term of this patent is extended or adjusted under 35 U.S.C. 154(b) by 0 days.

(21) Appl. No.: 10/573,011

(22) PCT Filed: Sep. 14, 2004

(86) PCT No.: PCT/EP2004/010265

§ 371 (c)(1),
(2), (4) Date: Aug. 16, 2006

(87) PCT Pub. No.: WO2005/033608

PCT Pub. Date: Apr. 14, 2005

(65) Prior Publication Data

US 2007/0051489 A1 Mar. 8, 2007

(30) Foreign Application Priority Data

Sep. 22, 2003 (DE) ..... 103 44 219

(51) Int. Cl.
*F28F 9/00* (2006.01)
*F28F 7/00* (2006.01)
*B60K 11/04* (2006.01)

(52) U.S. Cl. ..... 165/67; 165/79; 165/176

(58) Field of Classification Search ..... 165/140, 165/67, 76, 79, 176, 68, 69; 180/68.4, 68.6
See application file for complete search history.

(56) References Cited

U.S. PATENT DOCUMENTS 5,183,103 A * 2/1993 Tokutake ..... 165/67

(Continued)

FOREIGN PATENT DOCUMENTS

DE 195 43 986 A1 5/1997

(Continued)

OTHER PUBLICATIONS

Von Dieter Bauer, "Modultechnik in Der Motorkuehlung," ATZ Automobiltechnische Zeitschrift, Franckh'sche Verlagshandlung, vol. 95, No. 9, Sep. 1, 1993, pp. 1-3.

*Primary Examiner*—Tho V Duong
(74) *Attorney, Agent, or Firm*—Foley & Lardner LLP

(57) ABSTRACT

The invention relates to a heat exchanger module (1) for a motor vehicle, comprising at least one heat exchanger (2), preferably a coolant cooler, and laterally arranged plastic module supports (11, 12) which retain the heat exchanger module (1) and support the same on the vehicle. According to the invention, the heat exchanger (2) is provided with two receptacles (4, 5) having two longitudinal faces, one lateral face, and two front faces (4*a*, 4*b*, 4*c*; 5*a*, 5*b*, 5*c*) while the module supports are embodied as slip-on boxes (11, 12) which have the shape of the receptacles (4, 5), embrace the longitudinal, lateral, and front faces (4*a*, 4*b*, 4*c*-, 5*a*, 5*b*, 5*c*) thereof in a positive manner, and are secured to the front faces (4*c*, 5*c*) by means of locking hooks and/or snap-in hooks.

15 Claims, 4 Drawing Sheets

U.S. PATENT DOCUMENTS

| | | | | |
|---|---|---|---|---|
| 5,558,310 | A | 9/1996 | Furuie et al. | |
| 6,000,460 | A * | 12/1999 | Yamanaka et al. | 165/67 |
| 6,012,512 | A | 1/2000 | Ghiani | |
| 6,059,019 | A * | 5/2000 | Brost et al. | 165/67 |
| 6,397,937 | B1 | 6/2002 | Ghiani | |
| 6,533,027 | B2 * | 3/2003 | Gille et al. | 165/67 |
| 6,684,937 | B2 | 2/2004 | Lenz et al. | |
| 6,691,767 | B2 * | 2/2004 | Southwick et al. | 165/67 |
| 2002/0017381 | A1 * | 2/2002 | Ozaki et al. | 165/135 |
| 2002/0023735 | A1 * | 2/2002 | Uchikawa et al. | 165/81 |

FOREIGN PATENT DOCUMENTS

| | | | |
|---|---|---|---|
| DE | 197 22 097 | A1 | 3/1998 |
| DE | 197 31 999 | A1 | 2/1999 |
| EP | 1 213 554 | A2 | 6/2002 |
| EP | 1 297 979 | A2 | 4/2003 |
| FR | 2.833.691 | A1 | 6/2003 |
| GB | 2 373 571 | A | 9/2002 |
| JP | 06159976 | A * | 6/1994 |
| JP | 2002-168584 | A | 6/2002 |

* cited by examiner

HEAT EXCHANGER MODULE FOR A MOTOR VEHICLE

BACKGROUND OF THE INVENTION

The invention relates to a heat exchanger module for a motor vehicle, known through DE-A 197 31 999.

Heat exchangers for motor vehicles, in particular those which are arranged in the engine space of the motor vehicle, such as coolant/air coolers, refrigerant condensers, charge-air coolers or oil coolers, are in many cases combined into heat exchanger modules, what are known as cooling modules,. and inserted into the vehicle and fastened there as a preassembled unit. What are known as module supports, which are in most cases of multipart design, on the one hand connected to the heat exchanger module and on the other hand supported in the vehicle, serve for fastening such a cooling module.

A module support for a cooling module, which consists of a coolant/air cooler and also a refrigerant condenser, has become known through EP-A 1 213 554. The module support is designed as a U-shaped frame, into which the heat exchangers are inserted and which is then completed to form a closed support frame by a crosspiece. It is disadvantageous in this construction that the support frame has to be adapted to the dimensions of the heat exchangers and therefore cannot be used for heat exchangers with differing dimensions.

A module support which consists of two shell-like injection-molded plastic parts which each have a very branched geometrical structure and accommodate a water cooler and an air-conditioning condenser between them has been proposed in DE-A 197 31 999. Both heat exchangers are fastened to the module supports by additional fastening means, namely self-tapping screws. Moreover, the individual heat exchangers have additional holding means in the form of support pins and support webs in order that they can be held positively in the module supports. This construction of module supports is consequently very costly, inter alia on account of the complicated plastic mold for the module supports and the adaptation of heat exchangers and module supports in relation to one another.

SUMMARY OF THE INVENTION

It is an object of the present invention to configure a heat exchanger module of the kind referred to in the introduction more simply and without additional fixing means as far as its design and its fixing between heat exchangers and module supports are concerned so as thus also to reduce the production costs for the heat exchanger module as a whole.

According to the invention, it is proposed that a heat exchanger of the heat exchanger module, preferably a coolant/air cooler, comprises receptacles or header tanks with a simple box profile, that is with an approximately parallelepipedal design. The module supports are designed as what may be referred to as slip-on boxes with a similar box-shaped hollow profile and can consequently be "slipped on" over the receptacles/header tanks of the heat exchanger by a simple rectilinear movement, a positive connection being brought about between the slip-on boxes and the receptacles in two axial directions.

In the third axial direction, the slip-on boxes are preferably secured in relation to the receptacles by locking hooks or snap-in hooks. The advantage is thus achieved that the module supports are simply configured, can be produced at low cost and can be fixed without additional fastening means and merely by slipping-over. The heat exchanger module as a whole can then be fastened in the vehicle with the module supports fixed.

According to an advantageous development of the invention, fastening means in the form of fastening pins and/or fastening openings are provided on the -end faces of the module supports, that is at the top and at the bottom, these fastening means being designed in one piece with the plastic module supports. The heat exchanger module or cooling module as a whole is consequently supported at four points in the vehicle. In this connection, mounting is preferably effected in the vertical direction, that is from the top downward, the support pins first being introduced into corresponding bearings, for example rubber bushes, on the vehicle. Pins on the vehicle, fastened on a crosspiece for example, engage in the upper fastening openings in the module supports. This consequently results in the advantage of simple, rapid mounting of the heat exchanger module.

In a further advantageous development of the invention, fastening means for retaining additional parts such as, for example, a fan cowling or a charge air cooler, are arranged, that is molded on, on the longitudinal faces, that is the vertically extending faces. The additional parts can consequently also be mounted simply, for example hung in.

According to a particularly advantageous development of the invention, the heat exchanger is produced as an all-metal, or all-aluminum, heat exchanger. In particular, this is a coolant cooler which is soldered completely in one operation. This cooler comprises box-shaped coolant receptacles made from aluminum sheet, the end faces thereof being formed by extended side parts of the cooler. The U-profile of the coolant receptacle, in particular its side face, projects beyond the end face and consequently forms a stop face for the locking or snap-in hooks of the module supports. It is advantageous in this connection that no additional fastening means, that is constructional modifications, have to be applied to the receptacles of the all-aluminum cooler. Rather, the module supports are merely slipped on over the coolant receptacles and then fix themselves.

In a further advantageous development of the invention, the module supports comprise cutouts in the places where necks for the coolant or oil of an integrated oil cooler are provided on the receptacles. The positive connection between module support and coolant receptacles is not affected thereby.

According to a further advantageous development of the invention, a refrigerant condenser is integrated with the coolant cooler, so that the two heat exchangers form a unified block soldered in one operation. Such heat exchanger units have become known under the registered mark "Monoblock" of the applicant. It is advantageous in this connection that the cooler carries the condenser with it and is itself held by the module supports and supported in the vehicle.

The construction according to the invention with "lateral" module supports is not limited to cross-flow coolers with laterally arranged coolant receptacles but can also be applied to what are -known as falling-flow coolers with receptacles arranged at the top and at the bottom, that is the entire heat exchanger module can be rotated by 90°. In this connection, the position of the fastening means will advantageously likewise be shifted by 90°.

BRIEF DESCRIPTION OF THE DRAWINGS

An illustrative embodiment of the invention is described in greater detail below and shown in the drawing, in which.

DETAILED DESCRIPTION OF THE INVENTION

Figure 1:
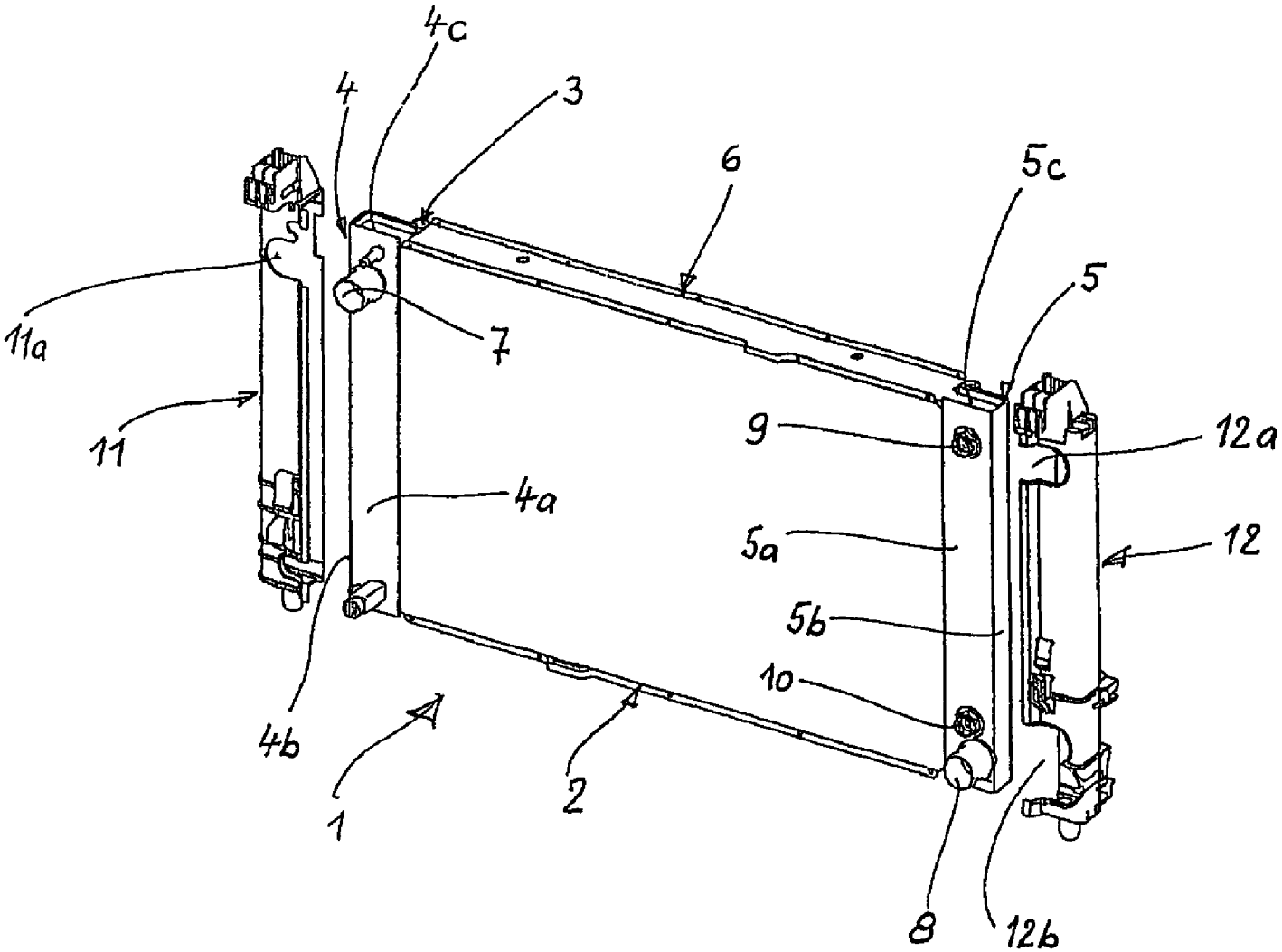
FIG. 1 shows a coolant cooler with integrated refrigerant condenser and also lateral module supports in an exploded illustration.

FIG. 1 shows an air-cooled heat exchanger unit 1, which consists of a front coolant cooler 2 and a largely concealed, rear refrigerant condenser 3. The heat exchanger unit 1 is produced in an all-aluminum construction and soldered in one operation; it is known under the registered mark "Monoblock" of the applicant and also described in DE-A 195 43 986 or DE-A 197 22 097—the subject matter of both laid-open specifications is included in full in the content of disclosure of this application. The coolant cooler 2 comprises two coolant receptacles 4, 5 of box-shaped design which are each formed by a U-shaped aluminum profile with longitudinal faces 4*a*, 5*a* and side faces 4*b*, 5*b* and closed by end faces 4*c*, 5*c*. The end faces 4*c*, 5*c* are recessed inward slightly and are formed by extensions of a side part 6 which engages in the U-profiles 4*a*, 4*b*, 5*a*, 5*b*. Inlet and outlet necks 7, 8 for a coolant and also connections 9, 10 for an oil cooler (not illustrated) arranged in the receptacle 5 are provided on the coolant receptacles 4, 5. To the side of both coolant receptacles 4, 5, module supports 11, 12 are shown in an exploded illustration, that is in a non-mounted state. The two module supports 11, 12 are produced as injection-molded plastic parts and comprise a box-shaped hollow profile which fits onto the box profile of the coolant receptacles 4, 5. The module supports 11, 12 comprise cutouts 11*a*, 12*a*, 12*b*, through which the necks 7, 8, 9, 10 extend after assembly.

Figure 2:
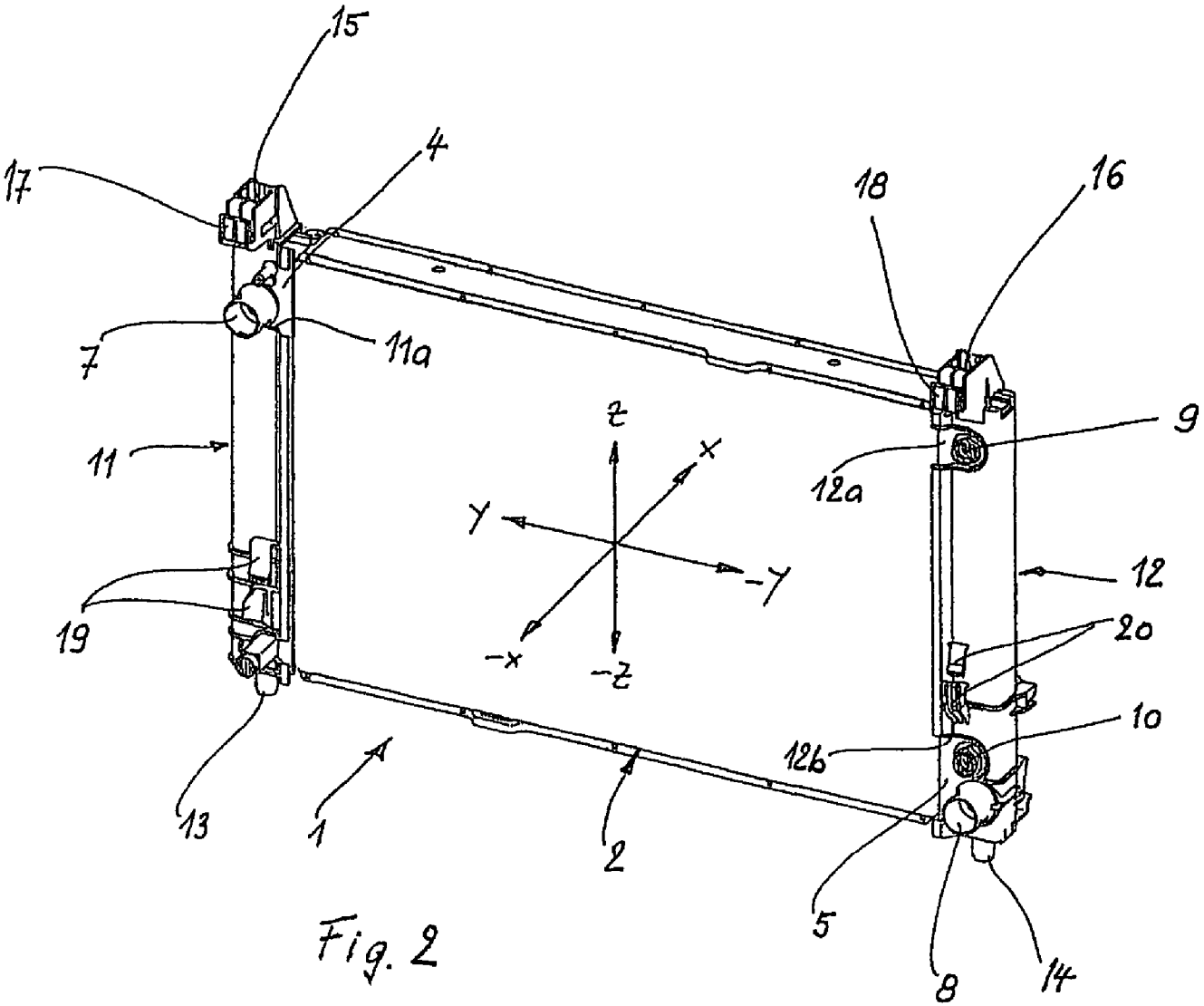
FIG. 2 shows the coolant cooler according to FIG. 1 with module supports mounted.

FIG. 2 shows the cooling module 1, or the coolant cooler 2, with the module supports 11, 12 in the mounted state. The module supports 11, 12 which, on account of their box-shaped hollow profile, are designed as what may be referred to as slip-on boxes, receive to a very great extent the coolant receptacles 4, 5 illustrated in FIG. 1 and form with them a positive connection in the direction of the X axis and the Z axis, the axes X, Y, Z being illustrated on the end face of the coolant cooler 2. The module supports 11, 12 are therefore not fixed by this positive connection in only the direction of the Y axis, that is in each case in one direction, this fixing being effected by locking hooks and snap-in hooks (not illustrated here) explained below. The module supports 11, 12 surround the receptacles 4, 5 with the exception of the cutouts 11*a*, 12*a*, 12*b* already mentioned, through which the necks or connections 7, 8, 9, 10 already mentioned extend. Fastening elements, which are designed as support pins 13, 14 on the lower side of the coolant cooler 2 and as fastening openings 15, 16 on the upper side, are arranged on the respective end faces or small faces of the module supports 11, 12. Furthermore, the module supports 11, 12 comprise on their side lying in the drawing plane fastening elements 17, 18, 19, 20 which are designed as upwardly or downwardly directed hooks for receiving additional parts such as, for example, a fan cowling (not illustrated). In a similar way, further fastening elements can be molded onto the module supports 11, 12 on the rear side.

Figure 3:
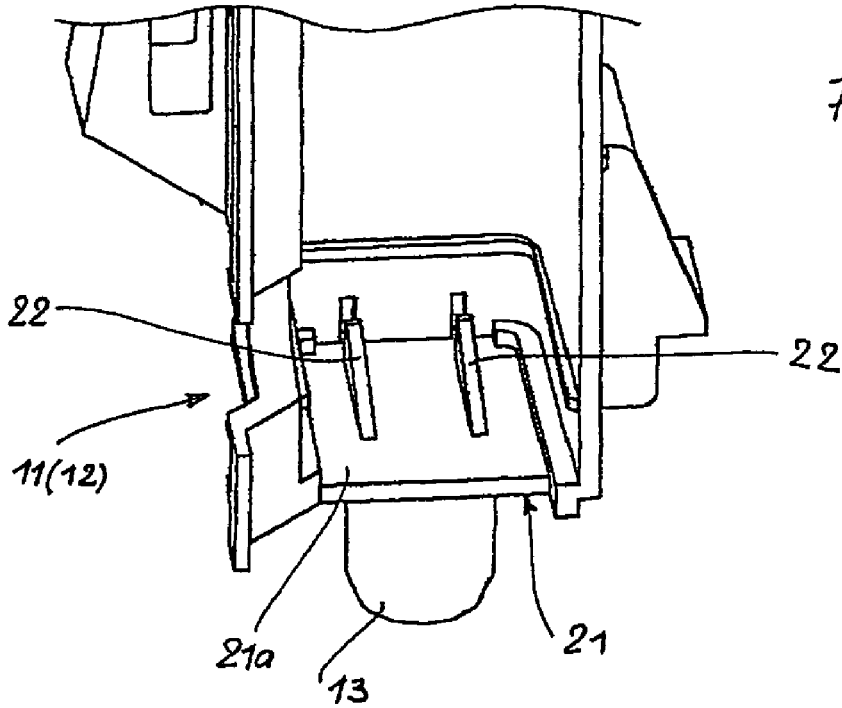
FIG. 3 shows locking hooks on the lower end face of a module support.

FIG. 3 shows a lower detail of one of the two module supports 11 (12) looking at its lower end wall 21 with inner end face 21*a*, from which two locking hooks 22 of wedge-shaped design are molded out. The support pin 13 for fastening on the vehicle side is located on the lower side of the end wall 21.

Figure 4:
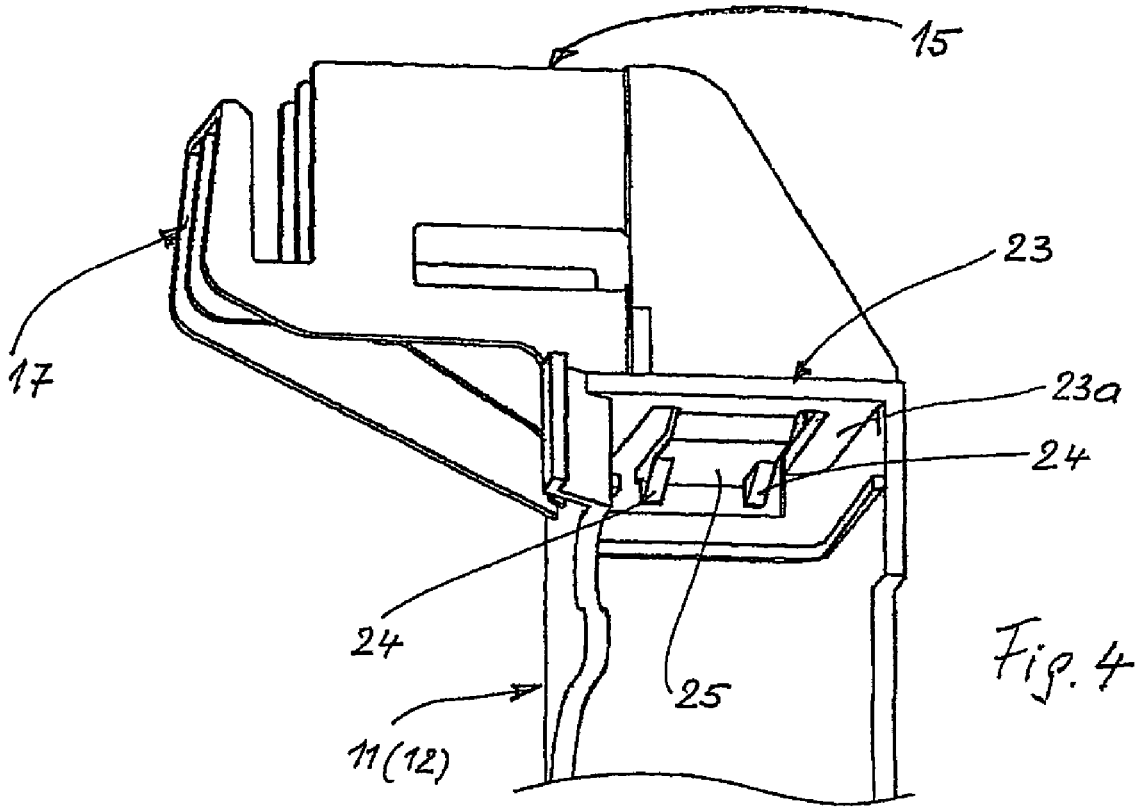
FIG. 4 shows snap-in hooks on the upper end face of a module support.

FIG. 4 shows an upper detail of one of the two module supports 11 (12) looking at its upper end wall 23 with inner end face 23*a*, from which two snap-in hooks 24 project on an elastic tongue 25. On the outer side of the end wall 23, the fastening opening 15 and the hook-shaped fastening element 17 are arranged on the module support 11 (12), that is connected in one piece to the module support 11.

Figure 5:
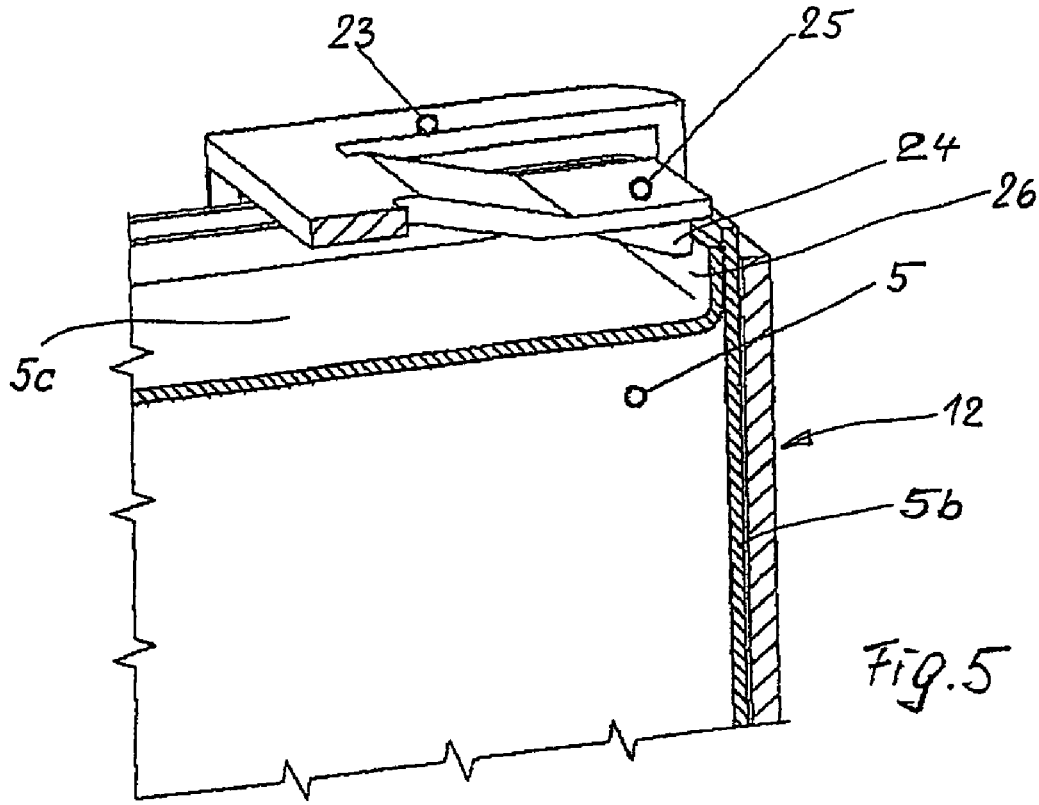
FIG. 5 shows the snap-in hooks in a mounted state with the coolant cooler.
Figure 6:
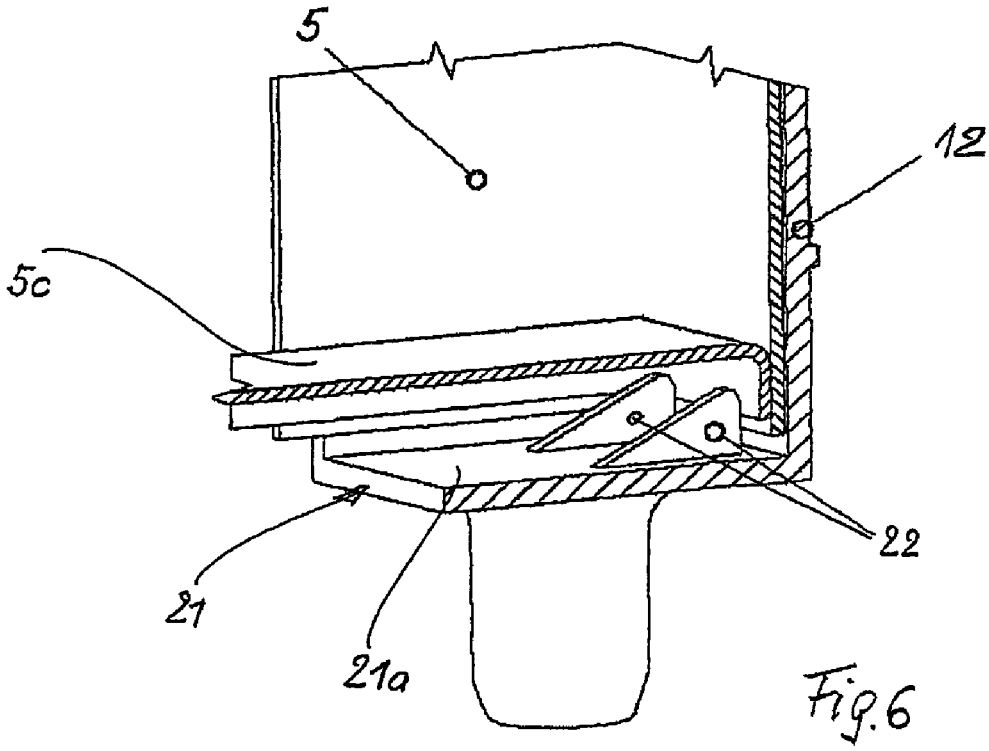
FIG. 6 shows the locking hooks in a mounted state with the coolant cooler.

FIG. 5 shows the elastic tongue 25 illustrated in FIG. 4 with one (visible) snap-in hook 24, the tongue 25 being molded out from the end wall 23, so that it acts resiliently like a leaf spring fixed at one end. The module support lies against the side face 5*b* (cf. FIG. 1) of the coolant receptacle 5, which is closed at the end by the end face 5*c*. The end face 5*c* is angled at the edge, in particular in the region of the side face 5*b*, and forms on the one hand a contact face for soldering together with the side face 5*b* and on the other hand a stop face 26 for the locking hooks 24. During assembly, the module support 12 is slipped on over the coolant receptacle 5. During this slipping-on movement, the snap-in hooks 24 slide up on the outer edge of the coolant receptacle 5, bend outward until the snap-in hooks 24 engage behind the stop face 26 and then snap in. With that, the locking or fixing of the module support 12 in relation to the coolant receptacle 5 is effected and secured. The fixing of the module support 11 to the coolant receptacle 4 is brought about in a similar way. FIG. 6 shows the lower region of the module support 12 as a detail, in particular with coolant receptacle 5 mounted. The locking hooks 22, which are of rigid or non-resilient design in contrast to the snap-in hooks 24 mentioned above, are molded out from the end wall 21. The end face 5*c* of the coolant receptacle 5 is designed similarly to the illustrative embodiment according to FIG. 5 and therefore likewise comprises a stop face 26 which, in conjunction with the rigid locking hooks 22, brings about locking of coolant receptacle 5 and module support 12. As the locking hooks 22 cannot be deflected, the module support 12 is during mounting put on at an angle in relation to the coolant receptacle 5, first being guided from below with the locking hooks 22 against the end face 5*c* and the stop face 26 and then pivoted in, the snap-in hooks 24 arranged on the opposite end wall 23 being able to snap in. The two module supports 11, 12 are of identical design as far as the locking and snap-in hooks 22, 24 are concerned and are consequently mounted in the same way. As already mentioned above, it is also within the scope of the invention to rotate the heat exchanger module described above with laterally arranged receptacles and module supports by 90° about the X axis (cf. FIG. 2), so that a falling-flow cooler with receptacles and module supports arranged at the top and at the bottom is obtained. The fastening pins 13, 14 mentioned above are then preferably to be attached to the lower module support, and the fastening openings 15, 16 accordingly to the upper module support. The fastening elements 17, 18, 19, 20 are to be rotated and moved in a similar way in order that the additional parts or assemblies can be hung in.

The invention claimed is:

1. A heat exchanger module for a motor vehicle, comprising:

at least one heat exchanger comprising two header tanks at opposing ends of the heat exchanger, each header tank having two opposing longitudinal side faces that face opposing sides of the heat exchanger and a longitudinal side face that forms one end surface of the heat exchanger, and two end walls that close opposing ends of the header tank; and a pair of module supports for holding and supporting the heat exchanger on the vehicle, wherein each module support is made of plastic and has a form of a slip-on box having an internal recess that fits the shape of one of the header tanks and positively surrounds the longitudinal side faces and end walls of the respective header tank, wherein each module support has a lower end wall, an upper end wall, a longitudinal wall connecting the upper and lower end walls of the module support, a locking hook arrangement at one of the upper and lower end walls of the module support, and a resilient snap-in hook arrangement at the other of the upper and lower end walls of the module support, wherein the upper and lower end walls of each module support run perpendicular to the longitudinal wall of the respective module support and run parallel to the end walls of the respective header tank, and wherein the locking hook arrangement and the resilient snap-in arrangement of each module support are for positively locking the respective header tank into the respective module support.

2. The heat exchanger module as claimed in claim 1, wherein the module supports comprise fastening pins on their lower end faces.

3. The heat exchanger module as claimed in claim 2, wherein the module supports comprise fastening openings on their upper end faces.

4. The heat exchanger module as claimed in claim 3, wherein the module supports further comprise on their longitudinal faces fastening means for receiving additional parts.

5. The heat exchanger module as claimed in claim 1, wherein the at least one heat exchanger comprises an all-aluminum heat exchanger.

6. The heat exchanger module as claimed in claim 1, wherein the two opposing longitudinal side faces of the header tanks and the longitudinal side faces of the header tanks that form end surfaces of the heat exchanger project beyond the end walls of the header tanks and form stop faces for the locking hook arrangements and the snap-in hook arrangements of the module supports.

7. The heat exchanger module as claimed in claim 6, wherein the snap-in hook arrangement of each module support is positioned to resiliently slide up on end edges of the respective header tank before engaging with the respective stop face for fixing the heat exchanger in the respective module support.

8. The heat exchanger module as claimed in claim 6, wherein the header tanks comprise necks for at least one heat exchanger medium and the module supports comprise cutouts which surround the necks.

9. The heat exchanger module as claimed in claim 6, wherein the at least one heat exchanger comprises an integrated heat exchanger block formed from a coolant cooler brazed to a refrigerant condenser.

10. The heat exchanger module as claimed in claim 1, wherein the locking hook arrangement of each module support comprises a fixed rigid locking hook arrangement which is rigid in comparison with the respective snap-in hook arrangement.

11. A heat exchanger module for a motor vehicle, comprising:

at least one heat exchanger comprising two header tanks at opposing ends of the heat exchanger, each header tank having two opposing longitudinal side faces that face opposing sides of the heat exchanger and a longitudinal side face that forms one end surface of the heat exchanger, and two end walls that close opposing ends of the header tank; and a pair of module supports for holding and supporting the heat exchanger on the vehicle, wherein each module support is made of plastic and has the form of a slip-on box having an internal recess that fits the shape of one of the header tanks and positively surrounds the longitudinal side faces and end walls of the respective header tank, each module support having a locking hook arrangement at one end and a resilient snap-in hook arrangement at its opposite end, for positively locking the respective header tank into the respective module support, wherein the locking hook arrangement of each module support comprises a fixed rigid locking hook arrangement which is rigid in comparison with the respective snap-in hook arrangement, wherein the locking hook arrangement of each module support is molded out of one lower end wall of the respective module support to form at least one wedge-shaped locking hook.

12. The heat exchanger module as claimed in claim 11, wherein the locking hook is arranged to engage with a recess formed at an end wall of the respective header tank.

13. A heat exchanger module for a motor vehicle, comprising:

at least one heat exchanger comprising two header tanks at opposing ends of the heat exchanger, each header tank having two opposing longitudinal side faces that face opposing sides of the heat exchanger and a longitudinal side face that forms one end surface of the heat exchanger, and two end walls that close opposing ends of the header tank; and a pair of module supports for holding and supporting the heat exchanger on the vehicle, wherein each module support is made of plastic and has the form of a slip-on box having an internal recess that fits the shape of one of the header tanks and positively surrounds the longitudinal side faces and end walls of the respective header tank, each module support having a locking hook arrangement at one end and a resilient snap-in hook arrangement at its opposite end, for positively locking the respective header tank into the respective module support, wherein the locking hook arrangement of each module support comprises a fixed rigid locking hook arrangement which is rigid in comparison with the respective snap-in hook arrangement, wherein the snap-in hook arrangement of each module support projects from an elastic tongue at one end wall of the respective module support.

14. The heat exchanger module as claimed in claim 13, wherein each snap-in hook arrangement comprises a wedge-shaped hook that is arranged to engage with a recess formed at an end wall of the respective header tank.

15. The heat exchanger module as claimed in claim 1, wherein the end walls of each header tank are recessed to provide a latching surface for engagement with the locking hook arrangement and the snap-in hook arrangement of the respective module support.

* * * * *